US005245812A

United States Patent [19]

Landers

[11] Patent Number: 5,245,812

[45] Date of Patent: Sep. 21, 1993

[54] METHOD OF STRENGTHENING A STRUCTURAL ELEMENT

[76] Inventor: Phillip G. Landers, 1119 Overlook Ct., San Ramon, Calif. 94583

[21] Appl. No.: 921,893

[22] Filed: Jul. 29, 1992

[51] Int. Cl.[5] ..... E02D 37/00

[52] U.S. Cl. ..... 52/514; 52/309.4; 264/36; 428/317.9

[58] Field of Search ..... 52/514, 232, 309.4; 264/36; 428/317.9

[56] References Cited

U.S. PATENT DOCUMENTS 4,905,441 3/1990 Landers .

*Primary Examiner*—Carl D. Friedman

*Assistant Examiner*—Creighton Smith

*Attorney, Agent, or Firm*—Thomas R. Lampe

[57] ABSTRACT

A structural element at least partially defining a void space is strengthened and stabilized by filling the void space with a structural foaming agent. The predetermined quantity of structural foaming agent used is such that it has the capacity to foam and expand, when unconfined, to a volume substantially greater than the volume of the void space. Bubbles created during the foaming of the structural foaming agent burst at the interface between deteriorated wood surrounding the void space to create a pulsing action which promotes impregnation of the deteriorated wood by the structural foaming agent.

5 Claims, 3 Drawing Sheets

METHOD OF STRENGTHENING A STRUCTURAL ELEMENT

TECHNICAL FIELD

This invention relates to a method for strengthening a structural element. More particularly, the invention has application to wooden structural elements, such as wood poles, which have a void space at least partially encompassed by wood in a state of deterioration.

BACKGROUND ART

Wooden structural elements, such as utility poles, posts or the like, are often damaged by rot and decay when exposed to the elements over a period of time. My U.S. Pat. No. 4,905,441, issued Mar. 6, 1990, makes note of the fact that woodpeckers are a substantial contributing factor to rot and decay of wood poles, creating void spaces within the interior of the poles they attack surrounded by rotten or deteriorating wood.

Quite a number of techniques have been employed in an attempt to strengthen deteriorated or rotten wood poles and the like. For example, non-foaming epoxies and polymers have been injected into the rotten portion. This approach has been less than successful because, among other things, the injected materials have been too viscous to penetrate the deteriorated wood. Thus, oxygen, which is a necessary contributing factor to wood rot (along with moisture and micro-organisms) can still reach the rotted area, and decay continues.

U.S. Pat. No. 4,905,441 discloses a system utilized to strengthen a structural element, such as a woodpecker-damaged wood pole. According to the patented method, structural foaming agent is inserted into the void space in an essentially unfoamed state. After the inserting step, a flexible container is positioned in the passageway leading from the exterior of the structural element to the void space, the flexible container having structural foaming agent therein.

The passageway is sealed by foaming the structural foaming agent within the flexible container to form a bond between the flexible container and the structural element at the location of the passageway.

The void space is then substantially filled after the step of sealing the passageway by foaming and expanding the structural foaming agent within the void space.

While the system disclosed in U.S. Pat. No. 4,905,441 is quite adequate for its intended purpose, it does have some drawbacks. First of all, utilizing the prior art system just described only a relatively small percentage of the decayed or rotten wood defining the void space is penetrated by the structural foaming agent. This is due to the fact that relatively little pressure is developed by the structural foaming agent during foaming thereof. Furthermore, utilization of a foaming agent-filled bag to seal the passageway requires significant time and effort. It has also been found that the foaming agent extruded through the bag does not penetrate the rotten or decayed wood surrounding the passageway to as great a degree as desireable.

DISCLOSURE OF INVENTION

The present invention obviates these difficulties. Utilizing the teachings of the present invention, significant penetration of decayed or rotten wood at the void space occurs, thus greatly increasing the structural integrity of the wood pole or other structural element. Furthermore, the present method requires no separate application of structural foaming agent to close off the void space. For those applications wherein the void space is in the interior of the wooden pole or other structural element, the foaming of the structural foaming agent within the void space itself operates to close off the passageway and seal the void space from external atmosphere. That is, the rotted area is completely cut off from a supply of oxygen, and further deterioration of the wood is prevented.

The teachings of the present invention are also applicable to strengthen a structural element having a void space at the exterior thereof. Such exteriorly disposed void spaces often are caused, for example, by what is known as shell rot, which may occur at or below ground level due to the action of moisture and decay organisms.

The method of the present invention is for strengthening a structural element at least partially defining a void space having a first volume and in communication with the ambient atmosphere, said void space being at least partially encompassed by wood in a state of deterioration.

According to the method, a predetermined quantity of structural foaming agent is inserted into the void space in an essentially unfoamed state, the predetermined quantity of structural foaming agent being sufficient to enable said foaming agent to foam and expand, when unconfined, to a second volume substantially greater than the first volume.

After the step of inserting the predetermined quantity of structural foaming agent into the void space, bubbles are created in the structural foaming agent to foam and expand the structural foaming agent. The void space is filled with the structural foaming agent during foaming thereof.

Foaming of the structural foaming agent is continued after the structural foaming agent has filled the void space while substantially confined to the void space and during the continued foaming, some of the structural foaming agent is forced into the deteriorated wood.

The structural foaming agent is hardened within the void space after the structural foaming agent has filled the void space and been forced into the deteriorated wood to form a secure bond between the structural foaming agent and the structural element.

The structural foaming agent has a plurality of discrete fibers therein and the method includes the step of moving and randomly orienting the fibers within the structural foaming agent during the creation of the bubbles in the structural foaming agent.

The step of forcing some of the structural foaming agent into the deteriorated wood is at least partially accomplished by bursting bubbles at the interface between the deteriorated wood and the structural foaming agent and filling the locations formerly occupied by the burst bubbles with structural foaming agent.

Other features, advantages, and objects of the present invention will become apparent with reference to the following description and accompanying drawings.

MODES FOR CARRYING OUT THE INVENTION

Figure 1:
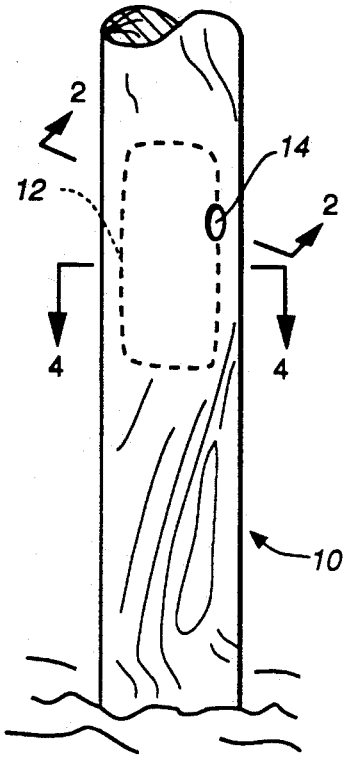
FIG. 1 is a perspective view of a wood pole with a woodpecker hole, said hole including a void space in the pole and a passageway leading thereto.

Referring now to FIGS. 1-5A, a structural element in the form of a conventional wood utility pole 10 is shown. The pole 10 defines a void space 12 therein. Void space 12 has a configuration typical of that formed by woodpeckers within utility poles and other wooden structures. A passageway 14, also caused by a woodpecker, leads from the exterior of pole 10 to the void space.

As can clearly be seen, passageway 14 is much smaller than the actual void space This is typical of the damage done by woodpeckers when creating nest holes in wood utility poles and other similar structures. The structural strength of such pole has actually been weakened far more by the woodpecker than one would be led to believe from simply observing the passageway 14. If not repaired, such damage can cause structural failure.

This is particularly true since rot or deterioration of the wood about the void space begins almost immediately after the woodpecker has formed the void space. Typically, the void space is surrounded by punky or deteriorated wood. In FIGS. 2-5 such a deteriorated or punky portion is delineated by dash line and designated by reference numeral 16.

Figure 2:
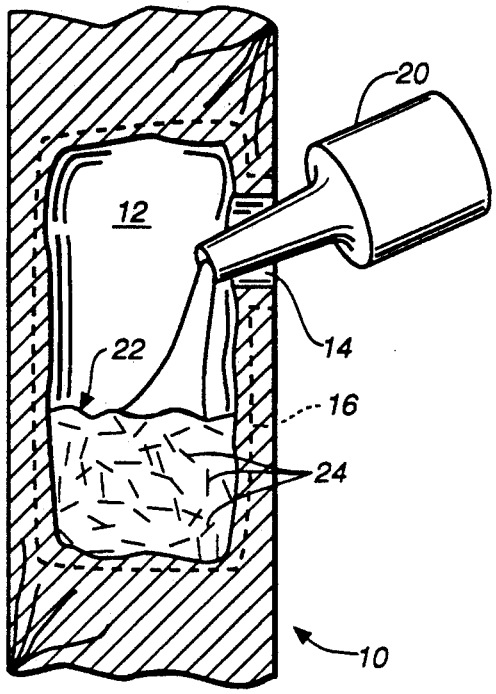
FIG. 2 is an enlarged, cross-sectional view taken along the line 2—2 of FIG. 1 and illustrating a structural foaming agent with fibers therein being introduced into the void space.
Figure 3:
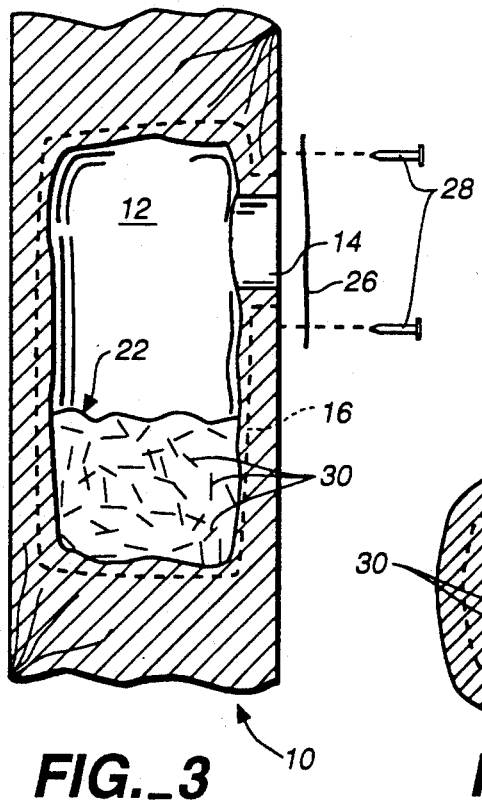
FIG. 3 is a cross-sectional view illustrating a barrier in the form of porous sheet material being attached to the structural element over the passageway.
Figure 4:
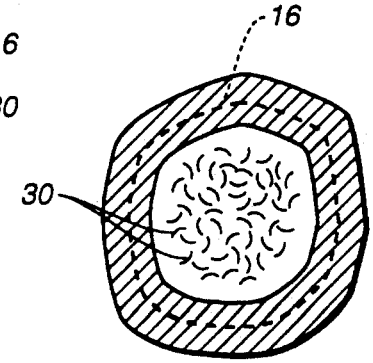
FIG. 4 is a cross-sectional view taken along the line 4—4 of FIG. 1 and illustrating in schematic fashion foaming of the structural foaming agent within the void space.

According to the method of the present invention repair of pole 10 is effected by first inserting structural foaming agent into void space 12 so that the structural foaming agent partially fills the void space while the structural foaming agent is in a essentially unfoamed state. This step is illustrated in FIG. 2 wherein a bottle 20 containing a liquid structural foaming agent has the outlet thereof inserted into passageway 14. The liquid structural foaming agent 22 falls under the influence of gravity to the bottom of void space 12 as illustrated. Of course, any other suitable means for inserting the foaming agent into the void space may be utilized.

The structural foaming agent 22 may be of any suitable type including that referenced in U.S. Pat. No. 4,905,441. It will be appreciated that the structural foaming agent of the type employed in the present invention is of a multi-component nature, said components being mixed to initiate the chemical processes involved in the foaming action just prior to use. A foaming agent found to be particularly useful in the practice of the present invention is carbonated epoxy marketed by I Corp-Ifoam Specialty Products, San Ramon, Calif., under the trademark "I-FOAM." Such product generates carbon dioxide bubbles even at elevated temperatures. Therefore, foaming occurs over an extended period of time, a factor important when practicing the present method.

It is very important when practicing the teachings of the present invention that the quantity of structural foaming agent inserted into the void space is sufficient to enable the foaming agent to foam and expand to a volume substantially greater than the volume of the void space. The volume of the void space may, of course, be determined quite readily by simply measuring same. Preferably, the quantity of foaming agent introduced into the void space should be sufficient that the foaming agent will, unless confined, foam to a volume at least one and one half times the volume of the void space. This is to be compared with the arrangement of U.S. Pat. No. 4,905,441, referenced above, wherein the quantity of structural foaming agent is such that it expands to a volume only slightly exceeding the volume of the void space.

Figure 5:
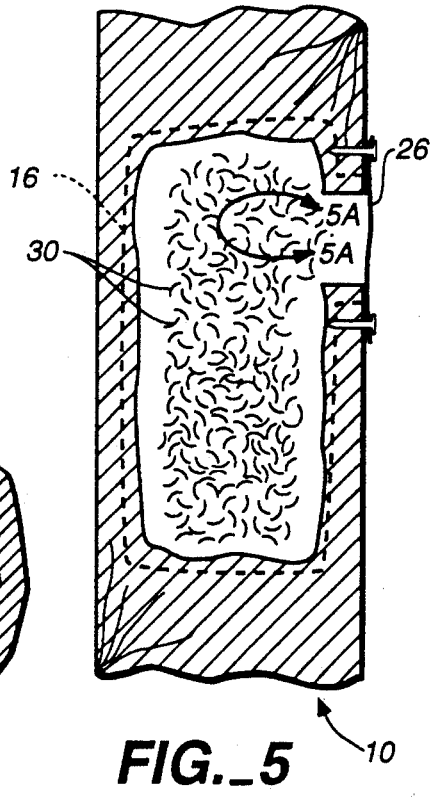
FIG. 5 is a cross-sectional, elevational view illustrating schematically the foaming of the structural foaming agent within the void space after the porous sheet material has been applied over the passageway leading from the void space to the ambient atmosphere.
Figure 5A:
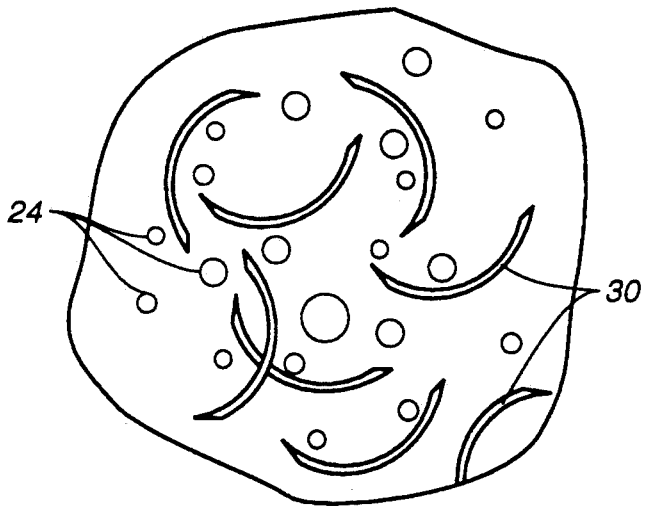
FIG. 5A is a greatly enlarged, fragmentary cross-sectional view of foamed structural foaming agent showing bubbles and fibers curving thereabout.
Figure 6:
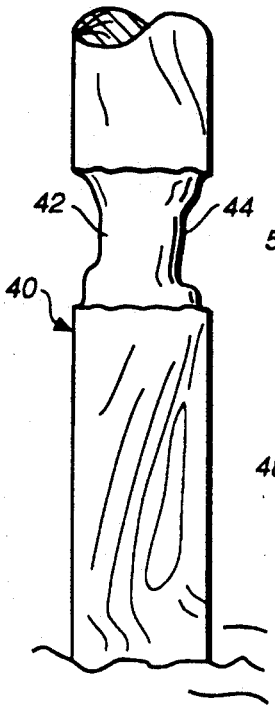
FIG. 6 is a frontal, perspective view of a wood pole having a void space at the exterior thereof which will be treated by an alternate embodiment method of the present invention.

In contrast to the prior art approach just described, it has been found that increasing the amount of structural foaming agent to provide foamed volume substantially greater than that of the void space will greatly enhance penetration of the deteriorated wood surrounding the void space by the foaming agent. This is not accomplished by any significant increase in the expansion pressure per se, but rather by virtue of the fact that bubbles created in the foaming agent during expansion thereof will burst when reaching the interface between the foaming agent and the deteriorated wood. This results in a pulsing or hammering action within the foaming agent mass itself. The locations formerly occupied by the burst bubbles at the interface between the deteriorated wood and the structural foaming agent is promptly filled with structural foaming agent which rams against, and intrudes itself into, the fibers of the deteriorated or rotten wood. The foaming agent is heated at the interface by the chemical reaction causing the foaming. The viscosity of the heated agent is low, thus increasing the effectiveness of the bubbling action. A highly integral bond is formed between the wood fibers and the structural foaming agent when the agent is hardened. In FIG. 5A, the bubbles are disclosed rather schematically and designated by reference numeral 24.

Before significant foaming of the structural foaming agent within the void space occurs, a barrier in the form of a porous sheet 26, such as canvas, is placed over passageway 14 to close same. Nails 28 or other suitable fasteners such as staples are utilized to secure the porous sheet 26 to the pole 10. It is important to note that the passageway 14 itself is surrounded by deteriorated wood. Thus, it is important that the fasteners be inserted into the pole in solid or good wood adjacent thereto.

As indicated above, the structural foaming agent will continue to foam and cause penetration of the punky wood defining the void space long after the structural foaming agent has filled the void space. Such action will also cause the structural foaming agent to enter the passageway 14 and bear against the porous sheet 26 and bulge it outwardly as shown in FIG. 5. A relatively small amount of the structural foaming agent will extrude through the pores of the barrier. Meanwhile, flexing or bulging of the barrier itself will allow the structural foaming agent to intrude into the space defined by the fasteners between the porous sheet and the pole surrounding the passageway at the external surface of the pole. This will create a cap which will positively secure the void space against intrusion by air, ensuring that no further rot or deterioration will take place therein. Additionally, the pulsating action of the foaming agent at the interface of the foaming agent and the deteriorated wood defining passageway 16 will further contribute to the strengthening and stabilizing of the pole.

The structural foaming agent has a plurality of discrete fibers 30 therein. Fibers 30 may be formed of fiberglass or any other suitable relatively high-strengthened fiber and are randomly disposed within the liquid structural foaming agent 22 when initially positioned in void space 12. One quarter inch has been found to be an appropriate fiber length.

U.S. Pat. No. 4,905,441, referenced above, teaches the use of fibers in a structural foaming agent. According to the method of U.S. Pat. No. 4,905,441 the fibers are oriented during foaming so that the major axes thereof are essentially unidirectionally disposed within the void space. This is due to the fact that the foaming of structural foaming agent terminates at or about the time the void space is filled thereby.

The method of the present invention differs from the method of U.S. Pat. No. 4,905,441 in that foaming of the structural foaming agent occurs long after the void space has been filled. In addition to the pulsing action described above with respect to the structural foaming agent, confinement of the structural foaming agent after filling of the void space serves to disperse the fibers within the foamed agent in a randomly oriented manner. Furthermore, considerable bending of the fibers will occur. This is believed to be due to the fact that the fibers will actually curve about the bubbles during the foaming action. This phenomenon is illustrated in FIG. 5A. Thus, a three-dimensional matrix of fibers is created within the foamed structural foaming agent greatly adding to the overall structural integrity thereof when hardened.

Furthermore, continued foaming of the structural foaming agent after it fills the void space will serve to direct some of the curved fibers to the interface between the structural foaming agent and the deteriorated wood. Likewise, randomly oriented fibers will be directed to the barrier 26 and mat thereon to form an interlocked matrix of fibers. This action also improves the strength and stability of the structure.

Referring now to FIGS. 6–10, an alternative embodiment of the method of the present invention is illustrated. A pole 40 has rotted at the exterior thereof to form a necked-in portion 42. That is, in the embodiment disclosed, a concavity 44 extends completely around the pole. The concavity 44 is typical of that which may be formed at or near the ground line of a utility pole or other similar wood structure. Typically also, the wood at the concavity is rotted and deteriorated by what is known as shell rot. In some cases, the concavity only extends partially about a pole where shell rot exists.

The method of the present invention may be employed to fill the concavity and strengthen the pole.

Figure 7:
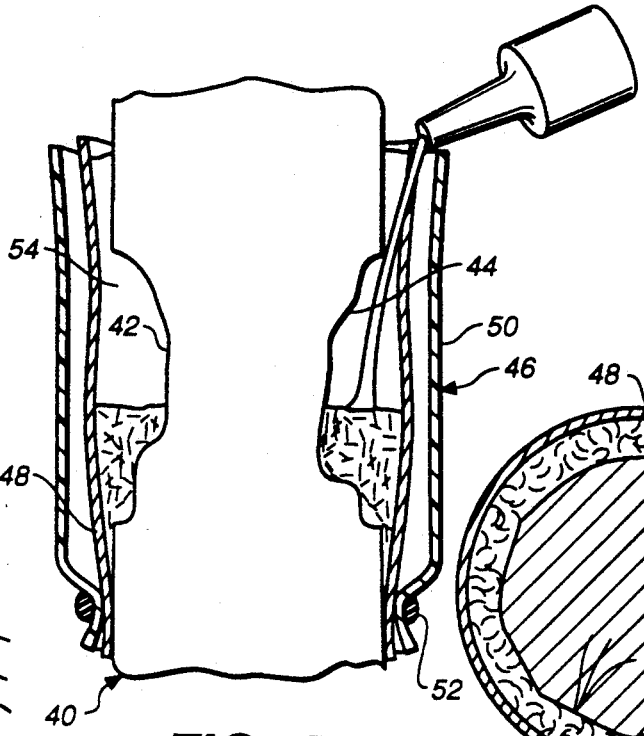
FIG. 7 is an enlarged, partial cross-sectional view showing the damaged segment of the wood pole and illustrating the initial steps of the alternative method of the present invention.
Figure 10:
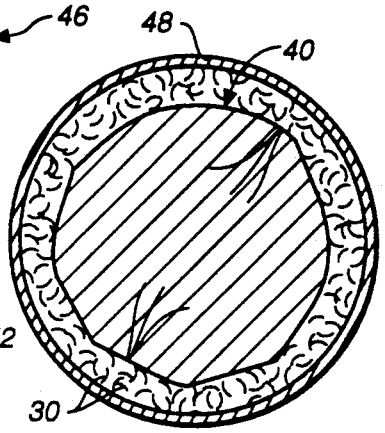
FIG. 10 is a cross-sectional view taken along the line 10—10 of FIG. 9.

The first step of the method is to affix a sleeve 46 to the pole below the location of concavity 44 as shown in FIG. 7. The sleeve has a porous or permeable inner sleeve component 48 and an outer sleeve component 50, said sleeve components being essentially concentric and extending completely about the pole. A suitable material for the inner sleeve component is porous fiberglass fabric and a suitable material for the outer sleeve material is polypropylene sheeting.

A cable 52 or other suitable binding means is employed to tightly wrap about the bottom end of the sleeve and place same into fluid-tight engagement with the pole.

It will be seen that the sleeve and the pole cooperate to form a void space 54 partially comprised of the concavity 44. Structural foaming agent is then poured between the pole and the inner sleeve component as shown in FIG. 7 to fill the void space. As was the case with respect to the first embodiment of the invention, the amount of structural foaming agent selected is such as to foam and expand, when unconfined, to a volume at least twice the volume of the void space.

Figure 8:
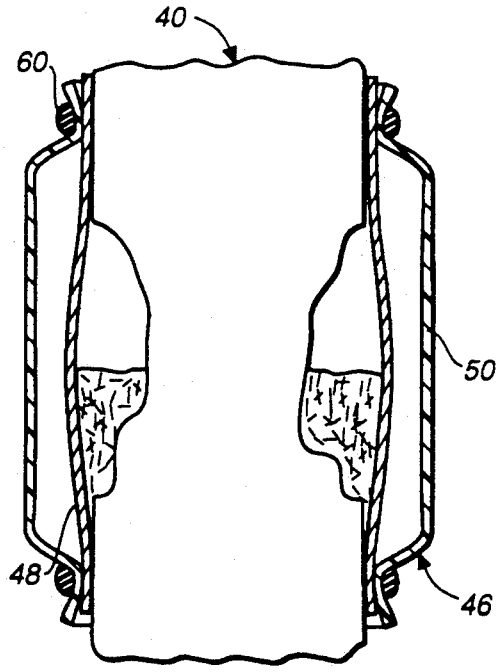
FIGS. 8 and 9 are views similar to FIG. 7, but illustrating subsequent sequential steps carried out when practicing the teachings of the alternative embodiment method of the present invention.

Referring now to FIG. 8, a second cable 60 is wrapped about the sleeve to bind same to the pole 40. While so confined, the structural foaming agent within the void space defined by the pole and the sleeve will expand to fill the concavity as well as the remainder of the void space, the outer dimension of which is determined by the fluid impermeable outer sleeve component 50. That is, the outer sleeve component acts as a mold.

The structural foaming agent will continue to foam an impregnate the deteriorated wood at the concavity 44. Furthermore, some of the foaming agent will extrude through the inner sleeve component 48. As was the case with respect to the first embodiment of the invention, the bubbles at the interface between the structural foaming agent and the deteriorated wood will burst to form a continuous pulsing action of the structural foaming agent to encourage impregnation of the deteriorated wood by the structural foaming agent. Also, of course, if fibers are employed in the foaming agent, as shown, they will form a three-dimensional matrix within the structural foaming agent and some of the fibers will mat at the interface between the structural foaming agent and the deteriorated wood as well as at the interface of the structural foaming agent and the inner sleeve component.

After the foaming of the structural foaming agent has taken place, the agent is allowed to harden. Then the cables 52, 60 are released and the outer sleeve component removed. The inner sleeve component will remain in place, being bound to, and to some extent imbedded in, the hardened structural foaming agent.

Figure 9:
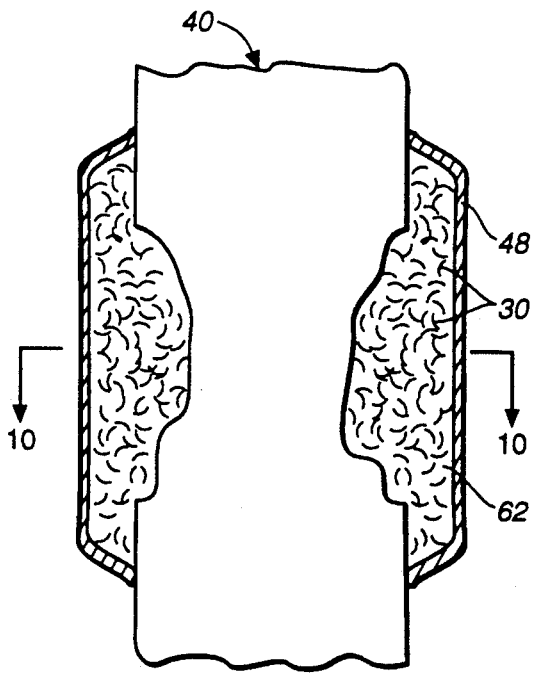

Removal of the outer sleeve component will result in a configuration similar to that shown in FIG. 9. That is, a cylinder of hardened structural foaming agent 62 with the sleeve 48 embedded at the outer periphery thereof will be formed about the pole, protecting against further deterioration or rot at the pole concavity. This will serve to strengthen and stabilize the pole as well as to prevent any oxygen from reaching the formerly rotted portion. As stated above, oxygen is a necessary contributing factor to decay of wood. Therefore, terminating the supply of oxygen will terminate decaying action.

It will be appreciated that the upper and lower extent of the hardened structural foaming agent cylinder will be at portions of the pole formed of good, solid wood. That is, the sleeve should be bound at the tops and bottoms thereof beyond the deteriorated wood defining the concavity. Any projecting ends of inner sleeve component 48 which may remain after hardening of the structural foaming agent cylinder can be cut or otherwise trimmed to present a neat appearance.

I claim:

1. A method of strengthening a structural element at least partially defining a void space having a first volume and in communication with the ambient atmosphere, said void space being at least partially encompassed by wood in a state of deterioration, said method comprising the steps of:

inserting a predetermined quantity of structural foaming agent into said void space in an essentially unfoamed state, said predetermined quantity of structural foaming agent being sufficient to enable said foaming agent to foam and expand, when unconfined, to a second volume substantially greater than said first volume;

after the step of inserting said predetermined quantity of structural foaming agent into said void space, creating bubbles in said structural foaming agent to foam and expand the structural foaming agent;

filling said void space with said structural foaming agent during foaming thereof;

continuing foaming of said structural foaming agent after said structural foaming agent has filled said void space;

during said continued foaming step, forcing some of said structural foaming agent into the deteriorated wood while substantially confining said foaming agent to said void space;

hardening said structural foaming agent within said void space after said structural foaming agent has filled said void space and been forced into said deteriorated wood to form a secure bond between said structural foaming agent and said structural element;

providing a barrier in the form of a sleeve surrounding said structural element in communication with said void space to substantially confine said structural foaming agent to said void space;

contacting said barrier with said structural foaming agent during foaming of said structural foaming agent in said void space whereby said structural foaming agent will harden at said barrier during said hardening step; and removing at least a portion of said sleeve from said structural element after hardening of said structural foaming agent.

2. The method according to claim 1 wherein said barrier is a sleeve surrounding said structural element, said method including the step of removing at least a portion of said sleeve from said structural element after hardening of said structural foaming agent.

3. The method according to claim 1 wherein said sleeve includes an outer fluid impermeable sleeve component and an inner fluid permeable sleeve component, said method including the steps of impregnating said inner fluid permeable sleeve component with said structural foaming agent during foaming thereof and bonding said structural foaming agent to said inner fluid permeable sleeve during hardening of said structural foaming agent, said removing step including removing said outer fluid impermeable sleeve component after said inner fluid permeable sleeve component is bonded to said structural foaming agent.

4. A method of strengthening a structural element at least partially defining a void space having a first volume and in communication with the ambient atmosphere, said void space being at least partially encompassed by wood in a state of deterioration, said method comprising the steps of:

inserting a predetermined quantity of structural foaming agent into said void space in an essentially unfoamed state, said predetermined quantity of structural foaming agent being sufficient to enable said foaming agent to foam and expand, when unconfined, to a second volume substantially greater than said first volume;

after the step of inserting said predetermined quantity of structural foaming agent into said void space, creating bubbles in said structural foaming agent to foam and expand the structural foaming agent;

filling said void space with said structural foaming agent during foaming thereof;

continuing foaming of said structural foaming agent after said structural foaming agent has filled said void space;

during said continued foaming step, forcing some of said structural foaming agent into the deteriorated wood while substantially confining said foaming agent to said void space; and hardening said structural foaming agent within said void space after said structural foaming agent has filed said void space and been forced into said deteriorated wood to form a secure bond between said structural foaming agent and said structural element, said second volume being at least one and one half times said first volume.

5. A method of strengthening a structural element at least partially defining a void space having a first volume and in communication with the ambient atmosphere, said void space being at least partially encompassed by wood in a state of deterioration, said method comprising the steps of:

inserting a predetermined quantity of structural foaming agent comprising carbonated foaming epoxy into said void space in an essentially unfoamed state, said predetermined quantity of structural foaming agent being sufficient to enable said foaming agent to foam and expand, when unconfined, to a second volume substantially greater than said first volume;

after the step of inserting said predetermined quantity of structural foaming agent into said void space, creating bubbles in said structural foaming agent to foam and expand the structural foaming agent;

filling said void space with said structural foaming agent during foaming thereof;

continuing foaming of said structural foaming agent after said structural foaming agent has filled said void space;

during said continued foaming step, forcing some of said structural foaming agent into the deteriorated wood while substantially confining said foaming agent to said void space; and hardening said structural foaming agent within said void space after said structural foaming agent has filled said void space and been forced into said deteriorated wood to form a secure bond between said structural foaming agent and said structural element.

* * * * *